United States Patent [19]

Flegel et al.

[11] 4,173,800

[45] Nov. 13, 1979

[54] LOW-PROFILE SYPHON TRAP

[75] Inventors: George J. Flegel, Michigan City; Roger L. Mielbeck, LaPorte; Patrick J. Pizarek, Michigan City, all of Ind.

[73] Assignee: Josam Manufacturing Co., Michigan City, Ind.

[21] Appl. No.: 936,354

[22] Filed: Aug. 24, 1978

Related U.S. Application Data

[63] Continuation-in-part of Ser. No. 827,065, Aug. 23, 1977, Pat. No. 4,130,907.

[51] Int. Cl.[2] ..... E03C 1/00

[52] U.S. Cl. ..... 4/207; 4/206; 4/300; 137/247.41; 137/247.49

[58] Field of Search ..... 4/1, 207, 206, 300, 4/197, DIG. 16; 137/249.41, 247.47, 247.49; 285/157

[56] References Cited

U.S. PATENT DOCUMENTS

| | | | |
|---|---|---|---|
| 1,198,893 | 9/1916 | Cooke | 4/300 |
| 2,486,736 | 11/1949 | Dodson | 4/300 |
| 3,579,662 | 5/1971 | Lowry et al. | 4/206 |
| 3,908,202 | 9/1975 | Sargent et al. | 4/300 |
| 3,967,324 | 7/1976 | Olive | 4/207 |
| 3,994,031 | 11/1976 | Bishop | 4/207 |
| 4,012,797 | 3/1977 | Kristoffersen | 4/300 |

*Primary Examiner*—Henry K. Artis

*Attorney, Agent, or Firm*—Isler and Ornstein

[57] ABSTRACT

A sanitary syphon gas trap particularly adapted for use in association with squat-type water closets, which are installed at floor grade level, which trap has an inlet arm and an outlet arm of circular cross-section, and an angularly disposed seal arm in rebent relationship to said inlet arm intermediate the inlet and outlet. The seal arm has an arcuate non-circular cross-section whose area is less than the flow area of said inlet arm and whose juncture with the outlet arm defines a flow-fall which is out of the main stream of the flow path between the seal arm and the outlet arm. A downwardly directed water jet from the water closet initiates a Venturi effect of high velocity flow in the seal arm for waste discharge.

8 Claims, 4 Drawing Figures

LOW-PROFILE SYPHON TRAP

CROSS-REFERENCE TO RELATED APPLICATION

This application is a continuation-in-part of our U.S. application Ser. No. 827,065 filed Aug. 23, 1977 for SQUAT-TYPE WATER CLOSET, now U.S. Pat. No. 4,130,907.

BACKGROUND OF THE INVENTION

In some areas of the world, local custom compels the use of squat-type water closets which are installed substantially flush with floor level and are "dry", in the sense that the bowl itself retains no standing body of water, in contrast to the more conventional upstanding water closets which are customarily provided with an integral trap which provides a standing pool of water in the bowl after each discharge of waste.

For a description of one form of squat-type water closet, reference is made to our aforesaid patent application which discloses in considerable detail the structural arrangement and illustallation of a squat-type water closet. Flushing water may be supplied from any suitable source, such as an elevated tank or a water-metering flush valve. In this type of water closet, high efficiency of waste discharge is imperative, as the geographical areas where such squat-type water closets are customarily used place great emphasis on the appearance of cleanliness.

It is somewhat ironic that the very areas in which the use of squat-type toilets is most customary, are geographical areas which suffer from severe shortages of adequate water supply and where conservation of water is an accepted way of life. As the countries in these geographical areas acquire modern sanitary facilities and build new structures for residential, commerical and industrial purposes, there is an awareness that modernization must not ignore the reality of the scarcity of water. There has been little or no technological effort in the prior art towards solving this problem which is essentially regional in character.

The present invention is directed toward the resolution of three problems associated with squat-type water closets and their installation. The foremost problem is the conservation of water in the operation of the water closet. A corollary of this is a reduction in conventional water requirements coupled with rapid and efficient discharge of waste. Thirdly, is the accomplishment of the foregoing objectives within the close and confined spaces resulting from the floor level installation of squat-type water closets.

We have found that these objectives can be considerably advanced by the use of an improved form of syphon trap particularly adapted for association with squat-type water closets. Attention is directed to U.S. Pat. Nos. 8,703, 336,805, 343,069, 477,499, 558,569 and 848,365 relating to various forms of traps. Both the age and disclosure of these patents emphasize the lack of prior art efforts directed to the objectives and concept above-mentioned.

SUMMARY OF THE INVENTION

The primary object of the invention is to provide an improved sanitary trap for water closets with improved efficiency of flushing discharge.

Another object of the invention is to provide a trap of the character described which will be accommodated in considerably less space than is the conventional practice, without any sacrifice in effective performance.

A further object of the invention is to provide a trap of the character described which will effectively function to discharge waste at reduced water consumption volumes.

Still another object of the invention is to provide a combination of a trap and squat-type water closet having an improved and more effective quality of waste discharge.

Other objects and advantages of the invention will appear during the course of the following description and by reference to the following drawings in which like reference characters designate like parts of the same.

DESCRIPTION OF THE PREFERRED EMBODIMENT

Figure 1:
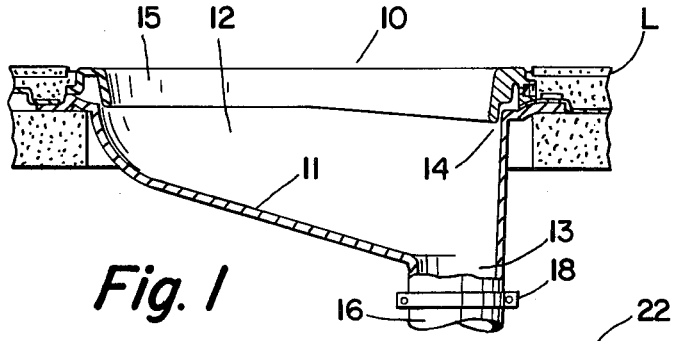
FIG. 1 is a side elevation of a squat-type water closet coupled to a sanitary waste discharge trap and embodying the features of the invention, portions thereof being broken away to show some detail.

A representative form of squat-type water closet is indicated generally by the reference numeral 10 and reference is made to the aforesaid application Ser. No. 827,065, now U.S. Pat. No. 4,130,907 for a detailed description of one such form of water closet. As illustrated, the water closet 10 is installed substantially flush with floor grade or floor level, the surface of which is designated by the reference character L. The walls 11 of the bowl 12 of the water closet are below floor level and converge toward a waste discharge opening 13 at the bottom of the bowl. A supply of flushing water from a suitable source, such as a water tank or metering flush valve (not shown), enters the bowl 12 at the rearmost portion 14 of the bowl rim 15 where a portion of the water is directed vertically downwardly into the opening 13 and another portion of the water is diverted around the periphery of the rim 15 so as to drain down and flush the walls 11 and discharge into the opening 13.

A syphon type of gas-sealing trap 16 has a vertically extending tubular inlet arm 17 of circular cross-section corresponding to the size of the circular opening 13 and adapted to be connected or coupled thereto in any suitable or conventional manner, as indicated by a compressible clamp connector 18.

Figure 2:
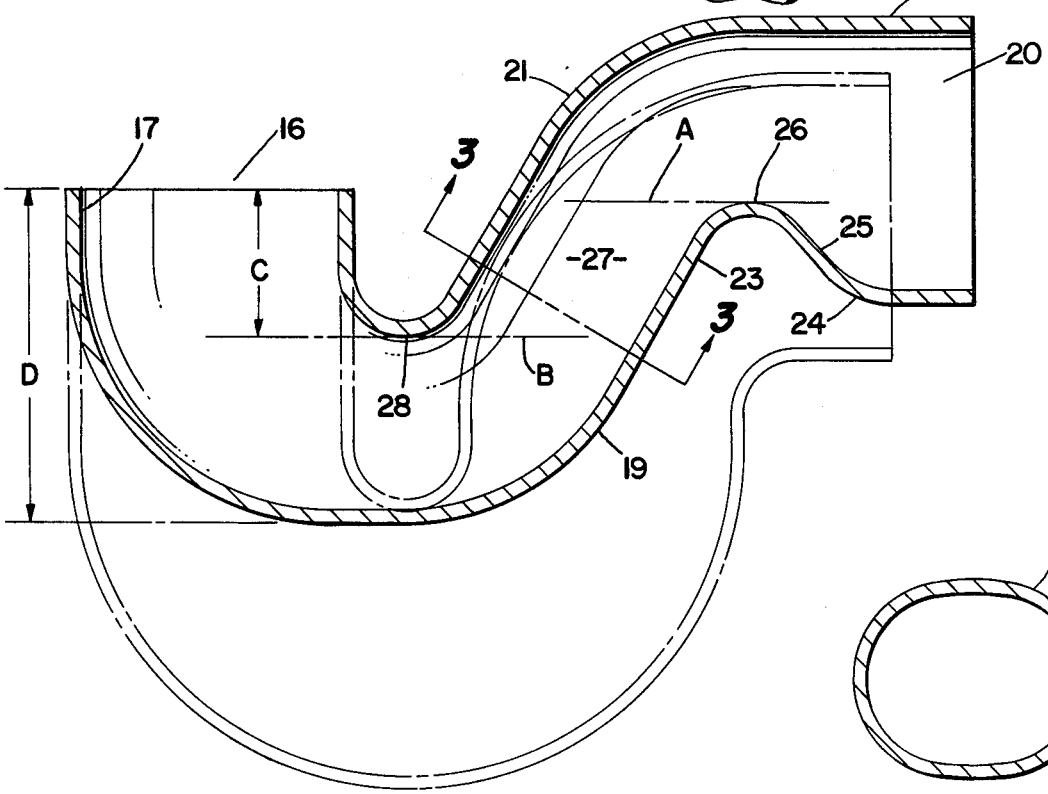
FIG. 2 is an enlarged vertical cross-sectional view of the trap of FIG. 1 with the phantom outline of a conventional trap superimposed thereon.

At its lowermost or downstream end, the inlet arm 17 joins the lowermost portion of a tubular seal arm 19 which extends angularly upwardly from the juncture in substantial rebent relationship to the vertical disposition of the inlet arm. The angle of disposition of the seal arm is acute to the vertical and will ordinarily be in the range of 20° to 45°. It is illustrated in FIG. 2 at an angle of 30°, but as will appear more fully hereafter, the determination of the minimum angle of disposition of the seal arm is dependent upon and correlated to the respective cross-sectional areas of the inlet arm and the seal arm.

Figure 3:
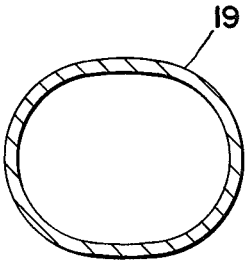
FIG. 3 is a transverse cross-section taken as indicated on line 3—3 of FIG. 2.
Figure 4:
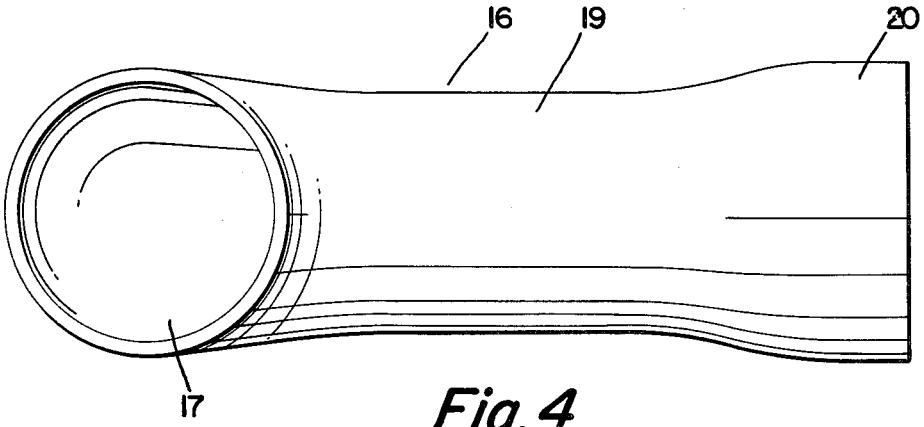
FIG. 4 is a top plan view of the trap of FIG. 2.

The seal arm 19 has an arcuate, non-circular tubular cross-section of essentially oval or elliptical form whose long dimension preferably lies in a horizontal plane, as illustrated in FIG. 3 of the drawings. This long cross-sectional axis of the seal arm should be of no greater length than the corresponding diameter of the inlet arm and preferably and desirably should be of lesser dimension than said diameter, as illustrated in FIG. 4 of the drawings.

The cross-sectional area of the seal arm should be sufficiently less than the cross-sectional area of the inlet arm to achieve the Venturi type of discharge effect hereinafter described. It has been found that when the cross-sectional area of the seal arm is at least 10% less than the cross-sectional area of the inlet arm, the desired flow action is achieved when utilizing inlet arms having nominal diameters in the ordinarily utilized range of 3 to 4 inches. It will be understood that as the extremes of size of the inlet arm diameter are approached, either in the very large diameters or in the very small diameters, that some adjustment and variation of this cross-sectional area ratio may be desirable or necessary.

The upper end of the seal arm 19 joins a horizontally extending tubular outlet arm 20 of circlar cross-section, whose cross-sectional flow area is greater than that of the seal arm 19 and ordinarily will be the same as that of the inlet arm 17. As illustrated in FIG. 2 of the drawings, at the juncture of the seal arm with the outlet arm, the upper surface 21 of the seal arm is aligned with or coextensive with the upper surface 22 of the outlet arm. The dimensional difference between the short cross-sectional axis of the seal arm and the diameter of the outlet arm is accommodated between the lower surface 23 of the seal arm and the lower surface 24 of the outlet arm by a blending or merger of these surfaces to define a downwardly angularly directed flow-fall portion 25 in the outlet arm immediately below the internal apex 26 of the bottom portion of the seal arm at its juncture with the outlet arm.

The above-described apex 26 defines the upper horizontal plane A of the gas-sealing chamber 27 of the trap when it holds water in normal operation. The horizontal plane A may be considered as the uppermost level of standing water in the trap. The juncture 28 between the upper portions of the inlet arm 17 and the seal arm 19 defines the lower horizontal plane B of the chamber 27 and represents the lowermost level of standing water in the trap which can still effectively serve as a gas seal. Therefore, the gas-sealing chamber 27 occupies the volume within the seal arm 19 which is defined between the horizontal planes A and B. The volume of standing water within this defined chamber 27 serves as a seal to prevent sewer gases and the like from passing through the trap from the outlet arm to the inlet arm.

The level of the upper plane A is below the level of the connection of the inlet arm to the waste opening 13. The level of the lower plane B may, in this improved form of trap, be a distance below the top of the inlet arm which is equivalent to less than ¾ of the internal diameter of the inlet arm. The improved efficiency of discharge of the trap 16 permits significant reductions in normally accepted dimensional requirments for the trap which results in a compactness and reduction in size of significant importance and advantage in the confined and limited space ordinarily available for installation of the under-floor sanitary fittings of squat-type water closets.

It will be observed that if the seal arm 19 were of circular cross-section and of the same size as the inlet arm 17 and, further, if the seal arm extended vertically upwardly in the conventional U-shape of traps, as indicated in phantom outline in FIG. 2 of the drawings, the gas-sealing chamber between the planes A and B would have an established volume of determinable value or magnitude. By utilizing a seal arm of smaller cross-sectional area than the inlet arm, such a vertically extending seal arm would have a lesser volume of chamber 27 between planes A and B than in the previously described example. However, by disposing the seal arm 19 at an acute angle relatively to the vertical, the effective length of the seal arm between the planes A and B is increased in the angular disposition, with a consequent increase in the volume of the chamber 27. For improved operation of the trap 16, it has been found that the seal arm 19 should be disposed at an acute angle which is sufficient to define a chamber 27 between the planes A and B whose volume is greater than the comparable volume which would exist between the planes A and B within the inlet arm 17, while still maintaining an adequate head of water between the planes A and B to effectively seal the trap against the escape of gases. Thus, by angular disposition of the seal arm, the volume of the chamber 27 and correspondingly the volume of standing water containable therein is greater than it otherwise would be on vertical disposition of the seal arm, despite the smaller cross-sectional area utilized for the seal arm. The enhanced volume and mass of standing water significantly improves the syphoning action of the trap as well as providing a greater reservoir against the effects of evaporation and consequent breaking of the seal in the dry climates where the use of squat-type water closets is prevalent.

In the operation of the trap, the flusing water is directed vertically downwardly from the rear portion 14 of the rim directly into the inlet arm 17 while at the same time the remainder of the flusing water which washes down the walls 11 of the bowl also converges upon the previously dry waste opening 13. The directed stream from the rim portion 14 acts as a jet impinging upon the standing water in the trap and initiating the high velocity syphoning action. By reason of the reduced cross-sectional area of the seal arm 19, a Venturi-like effect is created with the waste water flowing at higher velocity through the seal arm and into the outlet arm than the velocity of flow in the inlet arm. This high velocity flow passes over the apex 26 and overshoots the downwardly extending flow-fall 25 as it enters the larger cross-sectional area of the outlet arm. By reason of this flow pattern, the body of water flowing from the seal arm to the outlet arm is not obstructed and hindered in its flow by any low-lying water in the outlet arm at the juncture between these two arms. This results in a much more complete and rapid discharge of the waste water into the outlet arm even though a significantly reduced volume of flushing water is supplied to the bowl 12.

Comparative tests with squat-type water closets using both the conventional form of trap shown in phantom outline in FIG. 2 and the improved form of trap establish that the conventional trap requires at least a 25% greater volume of flushing water than the trap 16 to achieve the same quality of flushing action. The use of the trap 16 is effective to save and conserve about ½ gallon of flushing water for each flushing action which, with the conventional form of trap requires about 2½ gallons of water. As literally millons of gallons of flushing water are utilized daily in water closet operation in any given city, it is apparent that a substantial conservation of this regionally precious commodity is accomplished through use of the trap 16.

By utilizing the Venturi-like effect of the reduced cross-sectional area of the seal arm 19 and the jet stream effect directly into the dry bowl as previously described, the syphoning action of the trap is accelerated without the need of providing a substantial head of standing water for this purpose. Thereby it has proved feasible not only to make the trap shallower by reducing the dimension C, representing the distance between the inlet opening and the sealing surface 28, as previously described, but the overall vertical length of the inlet arm, indicated by the dimension D, can be shortened to no more than 1.5 times the internal diameter of the arm. In turn, the dimension C is less than half of the dimension D, in contrast to a substantially higher ratio required in conventional trap designs. The reduction in dimensions of the trap 16 adapts it particularly to use in the sub-floor installations of squat-type water closets where space is at a premium. The compactness of the trap 16 in contrast to conventional prior art trap structure is evident in the showing of FIG. 2 of the drawings.

Having thus described our invention, we claim:

1. In a syphon gas trap for a squat-type water closet, the combination of:

a tubular inlet area of circular cross-section extending substantially vertically downwardly and attachable to the waste discharge opening of a water closet, a tubular gas-seal arm in rebent relationship to said inlet arm and extending divergently angularly upwardly at an acute angle to said inlet and, said gas-seal arm having a substantially arcuate non-circular cross-section whose flow area is less than the flow area of said inlet arm, the juncture of said inlet arm and said gas-seal arm defining the lower horizontal plane of a gas seal chamber of said trap when holding water, a tubular outlet arm extending horizontally from the downstream end of said seal arm, said outlet arm being of circular cross-section and having a flow area greater than that of the seal arm, the juncture of the apex of the bottom portion of said seal arm and said outlet arm defining the upper horizontal plane of said gas-seal chamber, said juncture also defining an angular-downwardly directed flow-fall in said outlet arm downstream of said apex and out of the high velocity flow path of said seal arm into said outlet arm, and the angle of said seal arm being sufficiently large to define a gas-seal chamber having a greater volume than a chamber disposed between said planes would have in a vertically extending seal arm of the same cross-sectional area as said inlet arm.

2. The combination of a trap as defined in claim 1 and a dry bowl squat-type water closet for floor-grade installation, wherein:

said water closet provides a discharge water jet stream directed vertically downwardly into said inlet arm of said trap, and said jet stream initiates a Venturi effect of a higher velocity flow of water in said seal arm than the velocity of flow in said inlet arm.

3. A combination as defined in claim 1, wherein:

the vertical distance from the top of said inlet arm to the said lower horizontal plane of said gas-seal chamber is of a value less than 75% of the internal diameter of said inlet arm.

4. A combination as defined in claim 3, wherein:

the overall vertical length of said inlet arm is no greater than 1.5 times the internal diameter of said inlet arm.

5. A combination as defined in claim 3, wherein:

said seal arm is disposed at an angle of at least 20° to the vertical.

6. A combination as defined in claim 3, wherein:

the vertical distance from the top of said inlet arm to the said lower horizontal plane of said gas-seal chamber is of a value less than half of the overall vertical length of said inlet arm.

7. A combination as defined in claim 3, wherein:

the overall vertical length of said inlet arm is no greater than 1.5 times the internal diameter of said inlet arm, the vertical distance from the top of said inlet arm to the said lower horizontal plane of said gas seal chamber is of a value less than half of the overall vertical length of said inlet arm, and said seal arm is disposed at an angle of at least 20° to the vertical.

8. The combination of a trap as defined in claim 7 and a dry bowl squat-type water closet for floor-grade installation, wherein:

said water closet provides a discharge water jet stream directed vertically downwardly into said inlet arm of said trap, and said jet stream initiates a Venturi effect of a higher velocity flow of water in said seal arm than the velocity of flow in said inlet arm.

* * * * *